United States Patent [19]

Giannelli et al.

[11] Patent Number: 4,560,200

[45] Date of Patent: Dec. 24, 1985

[54] QUICKLY DISENGAGABLE LOCK FOR ADJUSTABLY POSITIONED SEAT

[75] Inventors: Raymond Giannelli, Ronkonkoma; Matthew R. Martin, Sayville, both of N.Y.

[73] Assignee: Lumex, Inc., Bay Shore, N.Y.

[21] Appl. No.: 508,138

[22] Filed: Jun. 27, 1983

[51] Int. Cl.[4] ..... A47C 1/06

[52] U.S. Cl. ..... 297/346; 297/172

[58] Field of Search ..... 297/172, 346; 248/429, 248/430

[56] References Cited

U.S. PATENT DOCUMENTS 2,673,595 3/1954 Kump ..... 297/172

3,450,425 6/1979 Leonhardt ..... 297/346 X

FOREIGN PATENT DOCUMENTS 571433 2/1924 France ..... 248/430

614793 12/1948 United Kingdom ..... 297/346

*Primary Examiner*—William E. Lyddane

*Assistant Examiner*—Joseph Falk

*Attorney, Agent, or Firm*—Edward H. Loveman

[57] ABSTRACT

An adjustable seat assembly comprises a horizontal seat. A pedestal is secured to the seat in a downwardly and forwardly inclined position and is secured to a carriage having two spaced frames extending around two elevated parallel rails. One frame has a top bar normally bearing on tops of the rails and a bottom bar spaced from the undersides of the rails. The other frame has a top bar spaced from the tops of the rails, and a bottom bar abutting the undersides of the rails and carrying a catch member which normally engages in one of a plurality of holes in the underside of the rails. When the seat is raised forwardly, the catch member disengages from the hole to permit longitudinal movement of the seat carriage along the rails.

9 Claims, 6 Drawing Figures

QUICKLY DISENGAGABLE LOCK FOR ADJUSTABLY POSITIONED SEAT

This invention concerns a seat assembly including a seat normally held in a locked position on a base frame, and releasable for longitudinal adjustment along the frame by slight forward raising of the seat.

Heretofore, seats adjustably positionable on horizontal rails have been locked in position by auxilliary bolts, pins, catches, or other mechanisms which require manipulation by an operator. Sometimes, it requires the use of tools or rather strenuous manipulation by the operator to engage and disengage the bolts, pins, or catches.

The present invention has as its principal object, the provision of a simplified, more easily operable locking means for a seat assembly useful with an exercising machine or other device requiring an adjustably positionable seat.

According to the invention a horizontal seat is provided with a downwardly and forwardly inclined pedestal secured to a carriage movable along elevated horizontal rails of a base frame. The carriage has two rectangular frame extending around the base frame. One frame has a top bar normally bearing on tops of the rails and a bottom bar spaced from undersides of the rails. The other frame has a top bar spaced from tops of the rails and a bottom bar carrying a catch member which engages in one of plurality of holes in the undersides of one of the rails. When the seat is raised slightly forwardly, the carriage rotates and the catch member disengages from the rail permitting the carriage to slide along the rails to another position. Releasing the seat allows it to drop rearwardly to re-engage the catch member with a hole in the underside of the rail.

The adjustable positioning of the carriage is accomplished without use of tools and does not use auxiliary bolts, pins, or catches which must be manipulated to lock and unlock them.

These and other objects and many of the attendant advantages of this invention will be readily appreciated as the same becomes better understood by reference to the following detailed description when considered in connection with the accompanying drawings in which.

Figure 1:
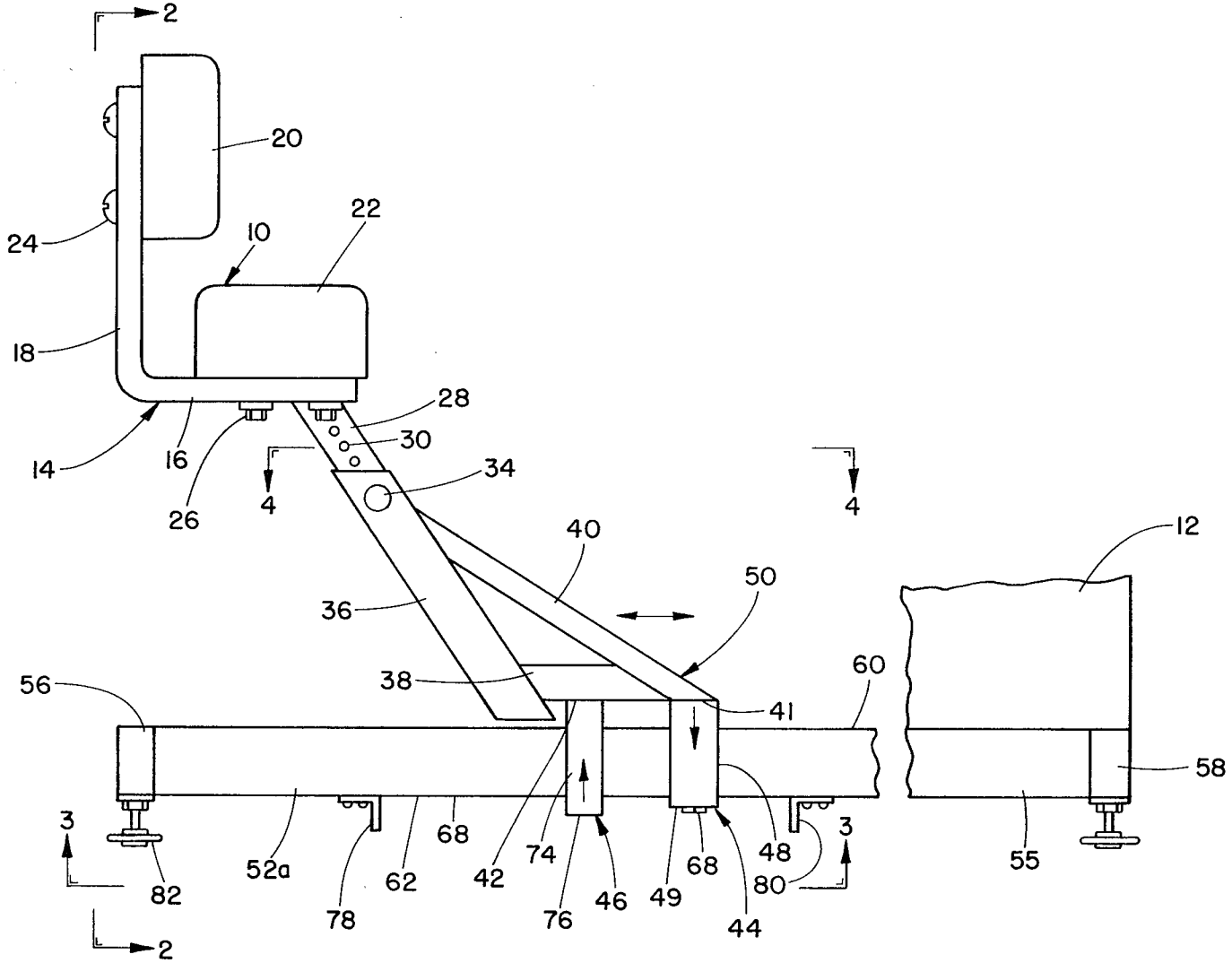
FIG. 1 is a side elevational view of a seat assembly embodying the invention parts of bottom rails being omitted.
Figure 2:
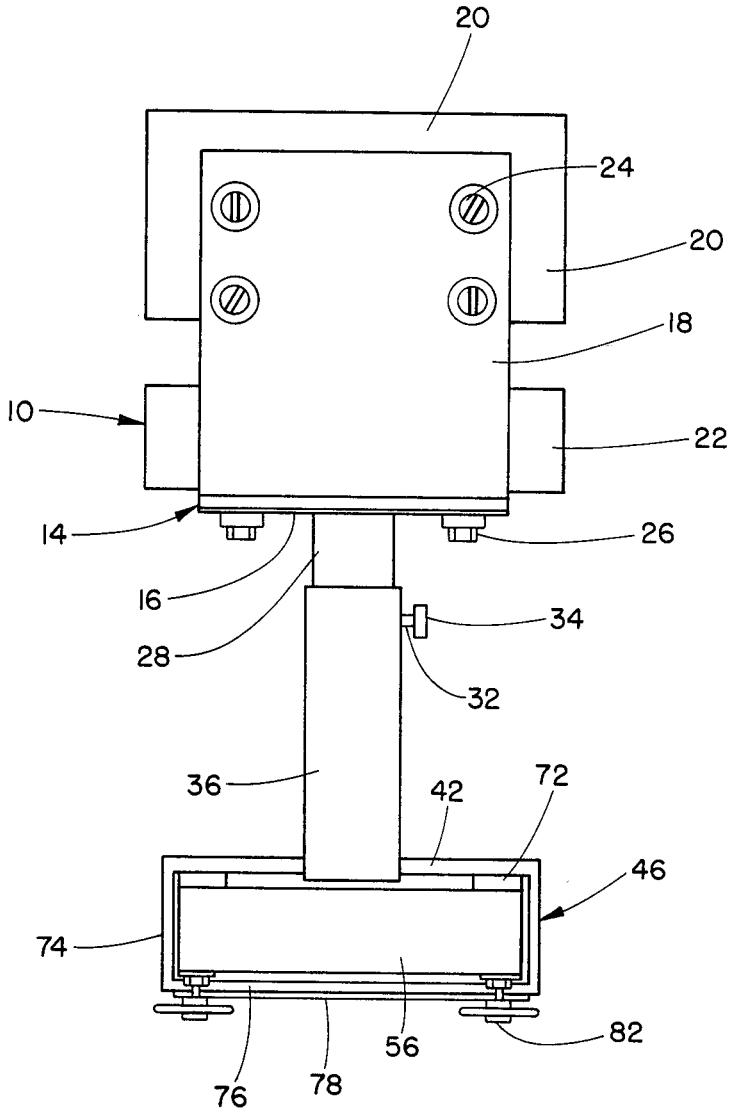
FIG. 2 is an end elevational view taken along line 2—2 of FIG. 1.
Figure 3:
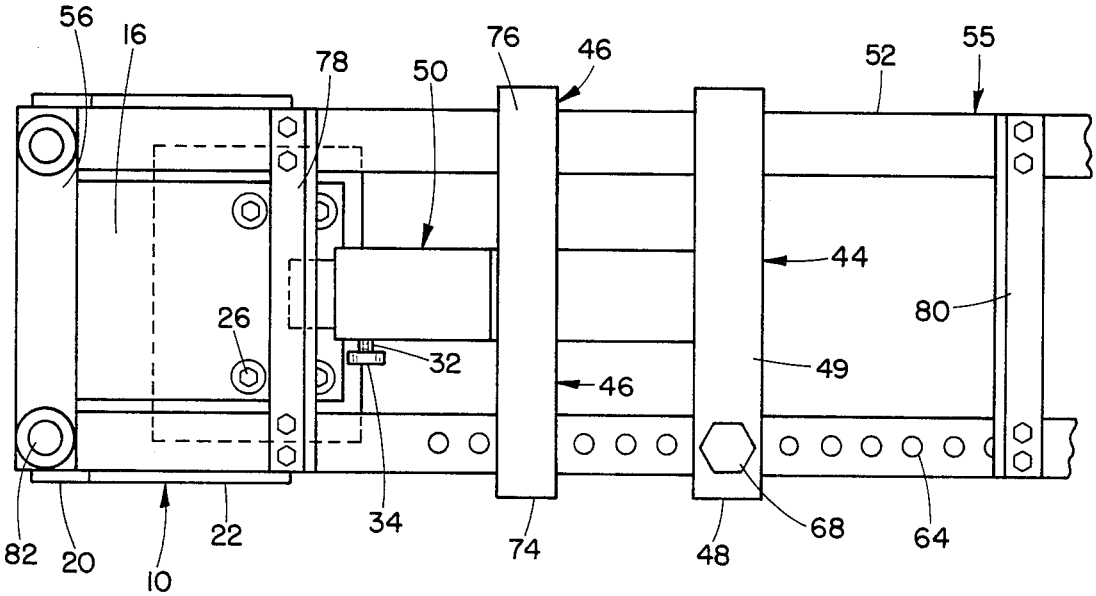
FIG. 3 is a fragmentary bottom plan view taken along line 3—3 of FIG. 1.
Figure 4:
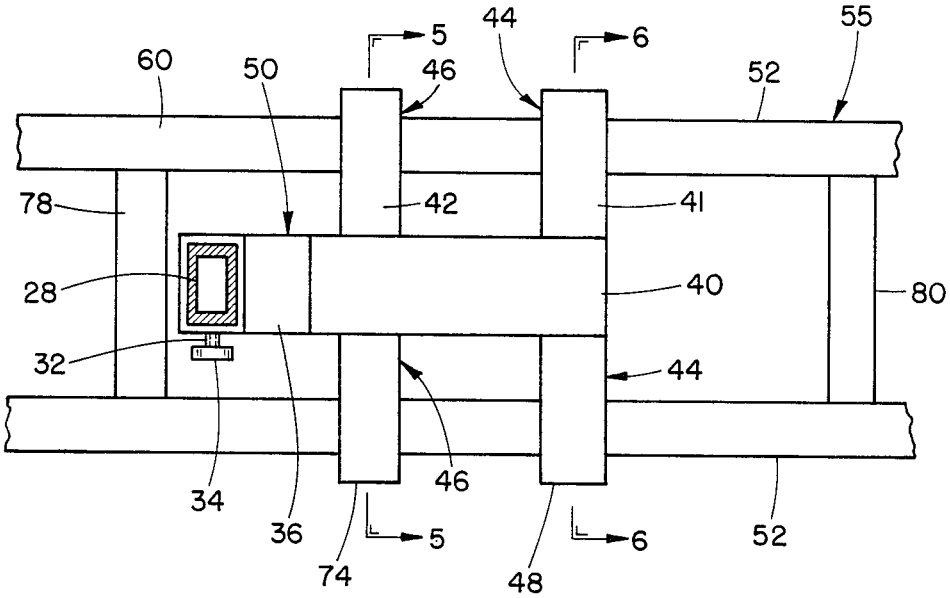
FIG. 4 is a fragmentary horizontal sectional view taken along line 4—4 of FIG. 1.
Figure 5:
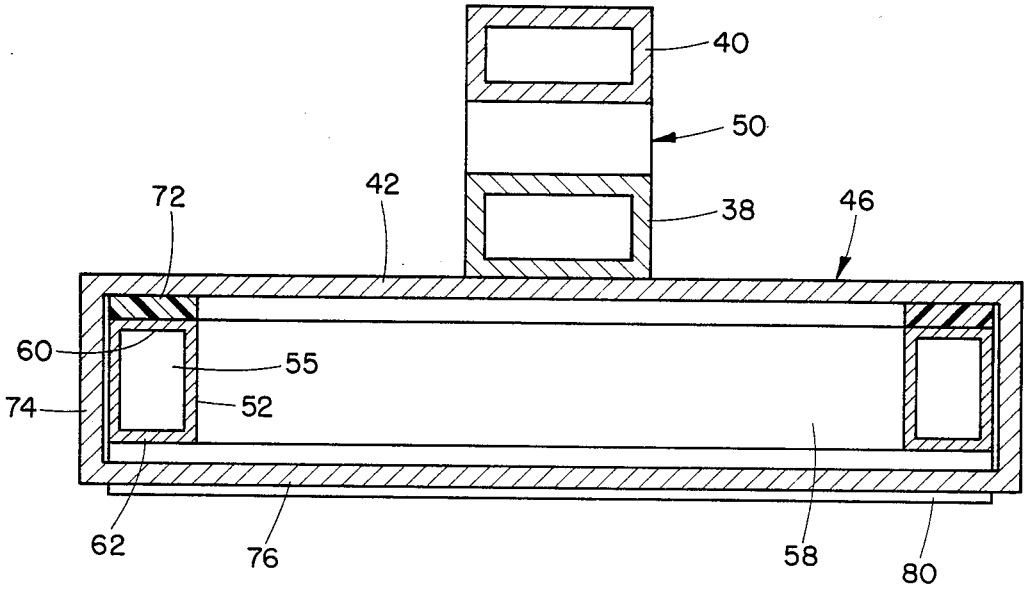
FIG. 5 is an enlarged cross sectional view taken along line 5—5 of FIG. 4.

Referring now to the drawings wherein like reference characters designate like or corresponding parts throughout, there is illustrated in FIGS. 1–6 a seat or chair generally designated by reference numeral 10 for use with an associated exercising device 12 or other apparatus requiring an adjustably positionable horizontal seat quickly lockable in desired position and quickly unlockable to permit easy repositioning of the seat 10. The seat 10 has an L-shaped frame 14 defining a horizontal platform 16 and an upright wall 18. Secured to the wall 18 is a padded seat back 20. Secured on the platform 16 below the seat back 20 is a padded cushion 22. The seat back 20 and cushion 22 may be held in place by bolts 24 and 26 respectively. Welded to the under side of the platform 16 is a forwardly inclined leg 28 secured near the front edge of the platform 16. The leg 28 inclines downwardly and forwardly at an obtuse angle has a series of holes 30, any one of which may be engaged by a bolt 32 turnable by a knob 34. The bolt 32 is carried at one side of a rectangular tubular pedestal 36 secured to movable seat carriage 50. The pedestal 36 inclines downwardly and forwardly in alignment with the leg 28 and is welded to one end of a horizontal support bar 38 and to one end of an angular support bar 40 whose other end is welded to the forward end of the bar 38, a lower end of the bar 38 is welded to the top of a cross bar 41. Rearwardly spaced from the cross bar 41 is another cross bar 42 on top of which is secured the horizontal support bar 38. The bars 41 and 42 define the top wall of a pair of respective rectangular frames 44, 46, forming parts of the seat carriage 50. The forward frame 44 has side walls 48 integral with opposite ends of the bar 40 and the bottom of a cross bar 49. The frame 44 extends around two horizontal laterally spaced rails 52 which are slightly spaced from the sidewalls 48. The two rails 52 together with end rails 56 and 58 define a rectangular base frame 68. The two rails 52 and the top and bottom walls 60, 62 form a box-type beam 55. The frames 44, 46 are spaced apart longitudinally of the rails 52.

Figure 6:
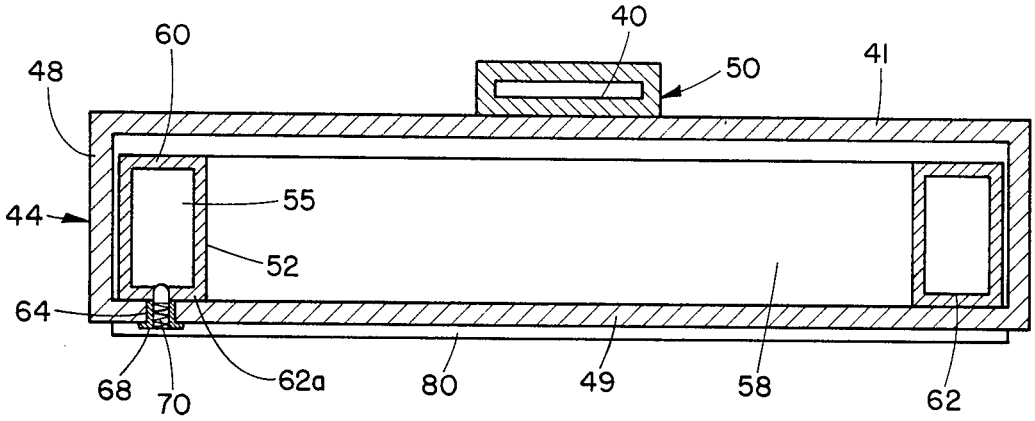
FIG. 6 is an enlarged cross sectional view taken along line 6—6 of FIG. 4.

The top bar 41 of the frame 44 is normally spaced from the top walls 60 of the box beam 55 as clearly shown in FIG. 6. The bottom cross bar 49 normally abuts the bottom wall 62 which has a series of holes 64 formed therethrough. (See FIG. 3) The holes 64 selectively receive the rounded head of a catch member 66 movably fitted in a bore in a plug 68 secured in the cross bar 49, see FIG. 6. A spring 70 in the plug 68 biases the catch member 66 upwardly to engage in a hole 64 in the bottom wall 62.

The rear frame 46 has a pair of pads or spacers 72, each secured to the underside of each of the top cross bars 42 to minimize friction and absorb the shock of the chair assembly when ever it is repositioned. (See FIG. 5) The cross bar 42 normally rests on the top walls 60 with the spacers 72 therebetween. The frame 46 has vertical side walls 74 slightly spaced from the outer sides of the rails 52. A bottom cross bar 76 of the frame 46 is integrally secured to the bottom ends of the side walls 74 and is spaced downwardly from the bottom walls 62 of the box 55 when the chair is not being positioned.

Two angle bars 78, 80 which are longitudinally spaced, are secured to the underside of the rails 52 and serve as stop members to limit forward and backward movement of the carriage 50. The feet 82 are secured to the undersides of the cross rails 56, 58, at corners thereof, and elevate the rectangular frame 68 above a floor or supporting surface and provide space for movement of the carriage 50.

It will be noted that the seat 10 is spaced rearwardly from the carriage 50. This tends to exert a counterclockwise turning moment as viewed in FIG. 1, which is resisted by the carriage 50 bearing against the rails 52. The bottom, forward cross bar 49 of the frame 44 is forced upwardly against the undersides **62*a* of the beam 55 pressing the catch member 66 securely into a hole 64 and preventing the carriage 50 from moving forward or rearward. At the same time, the top of the rear frame 46** with the spacers 72 is pressed down on the top wall 60 of the beam 55 providing a stable support for the seat 10.

When it is desired to move the seat 10 forwardly or rearwardly, the seat is slightly raised manually in a vertical plane and in a clockwise direction as viewed in FIG. 1. This will raise the rear frame 46 causing the bottom cross bar 76 to abut the bottom wall 62 of the beam 55. At the same time the cross bar 49 will move downwardly from the bottom wall 62 of the beam 55 to disengage catch member 66 from the hole 64 in the rail 52*a*. With the seat 10 positioned forwardly as described, the carriage 50 may easily slide or be moved forwardly or rearwardly on the frame 68 to a new location where the catch member 66 can engage in another hole 64. Upon releasing the seat 10, it will turn of its own weight slightly counterclockwise to the position shown in FIG. 1. There, the carriage 50 will again be locked in position preventing forward or rearward movement of the seat 10 and carriage 50. The weight of a person sitting on the seat 10 will increase the locking effect.

The structure is very strong. It is safe and foolproof in operation. Forward and rearward adjustment of position is done quickly without the use of tools, loosening and tightening of parts, or any other complicated manipulations.

The parts of the pedestal, base frame and carriage can be made of bar stock of any shape, i.e. round, rectangular, square, etc. . . The assembly is economical to manufacture, and will provide long, troublefree service. It should be understood that although only one catch has been illustrated and described for locking the seat assembly, two catches, i.e. one locking the bar to each rail may be provided. Moreover, if desired, a catch may be provided to lock the top bar 60 of the rear frame 46 to the rail 52 rather then the bottom bar 62*a* of the front frame 44 as has been illustrated and described.

It should be understood that the foregoing relates to only a preferred embodiment of the invention which has been by way of example only, and that it is intended to cover all changes and modifications of the example of the invention herein chosen for the purposes of the disclosure, which do not constitute departures from the spirit and scope of the invention.

What is claimed is:

1. An adjustable seat assembly, comprising:

a horizontal seat for supporting the weight of a person in sitting position;

a pedestal supporting said seat in an elevated position;

a base frame having fixed horizontal side rails and feet secured to said base frame to elevate same;

a carriage slidably mounted on said base frame, said pedestal secured to said carriage, so that said seat is movable forwardly and rearwardly above and parallel to said rails said carriage comprising:

first and second rectangular frames extending around said base frame;

said first frame having a first top cross bar bearing on tops of said rails, and a first bottom cross bar spaced from the undersides of said rails;

said second frame having a second top cross bar spaced from the tops of said rails, and a second bottom cross bar abutting the undersides of said rails;

said first frame being disposed between said second frame and said seat longitudinally of said rails; and catch means carried by said carriage engaged with one of said rails to prevent movement of said carriage along said rails, said catch means so arranged that slight elevation of said seat in one direction in a vertical plane with respect to said base frame will disengage said catch means from said rail to permit movement of said carriage along said rails, whereby slight depression of said seat in a direction opposite to said one direction will re-engage said catch means with said rails.

2. An adjustable seat assembly as defined in claim 1, wherein said catch means comprises a catch member extending upwardly toward one of said rails, the underside of said one rail having holes for receiving said catch member.

3. An adjustable seat assembly as defined in claim 1, wherein said pedestal supports said seat in a position offset from said carriage longitudinally of said rails, so that the weight of a person sitting on said seat prevents disengagement of said catch means from said rails.

4. An adjustable seat assembly as defined in claim 3, wherein said catch means comprises catch members extending upwardly from said second bottom cross bar to engage said undersides of said rails.

5. An adjustable seat assembly as defined in claim 4, wherein said catch members are spring biased upwardly, said undersides of said rails having longitudinally spaced holes for selectively receiving said spring biased catch members.

6. An adjustable seat assembly as defined in claim 5, wherein said pedestal comprises a tubular member secured to support bars in an angular position so that said seat is supported rearwardly from said first and second rectangular frames to stabilize said seat and said carriage on said rails and to facilitate rotation of said seat for engaging and disengaging said catch means with and from said rails, respectively.

7. An adjustable seat assembly as defined in claim 6 wherein said pedestal support bars are secured to upper sides of said first and second top cross bars for carrying said seat rearwardly of said first and second frames.

8. An adjustable seat assembly as defined in claim 7, wherein said carriage further comprises a leg secured to the underside of said seat near its front edge and depending therefrom in an inclined forward position, said leg being adjustably positioned in said tubular member for carrying said seat offset from said carriage.

9. An adjustable seat assembly as defined in claim 8, further comprising stop members secured to said rails to limit forward and rearward movements of said carriage along said rails.

* * * * *